US007401565B2

(12) United States Patent
Nixon et al.

(10) Patent No.: US 7,401,565 B2
(45) Date of Patent: Jul. 22, 2008

(54) PORT SECURITY BARRIER

(75) Inventors: Laurence Nixon, Port Hueneme, CA (US); William Seelig, Rockville, MD (US); Stephen Slaughter, Costa Mesa, CA (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 80 days.

(21) Appl. No.: 11/602,429

(22) Filed: Nov. 6, 2006

(65) Prior Publication Data

US 2008/0105184 A1 May 8, 2008

(51) Int. Cl.
*B63G 9/04* (2006.01)

(52) U.S. Cl. ..... 114/241; 114/240 C; 114/240 D; 114/240 E

(58) Field of Classification Search ..... 114/241, 114/240 R, 240 E, 240 D, 240 C
See application file for complete search history.

(56) References Cited

U.S. PATENT DOCUMENTS 1,151,607 A * 8/1915 Newhall et al. ..... 114/241
1,217,812 A * 2/1917 O'Grady ..... 114/240 B
1,326,156 A * 12/1919 Elia ..... 114/240 E
1,353,811 A * 9/1920 Muncy ..... 114/240 E
3,132,433 A * 5/1964 Luketa ..... 43/7
6,591,774 B2 * 7/2003 Metherell et al. ..... 114/241
6,681,709 B1 * 1/2004 Nixon et al. ..... 114/241
6,843,197 B1 * 1/2005 Nixon et al. ..... 114/241
6,960,047 B2 * 11/2005 Knezek et al. ..... 405/211
7,044,076 B2 * 5/2006 Knezek et al. ..... 114/267
7,140,599 B1 * 11/2006 Spink ..... 256/13
2006/0034668 A1 * 2/2006 Knezek et al. ..... 405/211
2006/0037526 A1 * 2/2006 Knezek et al. ..... 114/267

* cited by examiner

*Primary Examiner*—Michael J. Carone
*Assistant Examiner*—Daniel J Troy
(74) *Attorney, Agent, or Firm*—David S. Kalmbaugh

(57) ABSTRACT

The port security barrier includes multiple barrier float assemblies connected to one another to form a barrier to stop, delay and discourage attacks by high speed boats of sixty five feet or less in length on high valued waterfront assets such as ports and docking facilities. The port security barrier includes multiple barrier floats coupled to one another by flange connectors. Each barrier float assembly also has a capture nylon net which is used to capture the high speeds and prevent an intrusion into restricted waters.

14 Claims, 8 Drawing Sheets

PORT SECURITY BARRIER

BACKGROUND OF THE INVENTION

1. Field of the Invention

The present invention relates generally to a security barrier for use at a port or the entrance to an inland waterway which receives ships laden with cargo or military watercraft. More specifically, the present invention relates to a port security barrier which is economical, easy to transport and assemble and provides sufficient strength to stop, delay and discourage attacks by boats of 65 feet or less in length on high valued waterfront assets.

2. Description of the Prior Art

There is currently a need within the Department of the Navy to provide protection for military watercraft which are moored at ports or inland waterways. In particular, there is a need to provide protection for military watercraft against explosive laden boats while the watercraft are moored at a port or an inland waterway.

There is also need to keep initial cost as low as possible and also meet military security requirements by (1) making the barrier as light as practical; (2) using low-cost standard materials where ever practical; (3) making the system as simple as possible; and (4) making the barrier easy to assemble and deploy.

Maintenance cost of the port security barrier are also a consideration. Low maintenance cost are generally achieved by using composite materials and keeping the port security barrier simple and minimizing the number parts required to keep the barrier operational.

Further operational cost need to be kept at low levels. Low operational cost can be achieved by the port security barrier light weight and keeping wind, current and wave loading on the barrier as low as practical so that operators can easily open and close barrier gates.

SUMMARY OF THE INVENTION

The present invention overcomes some of the difficulties of the past including those mentioned above in that it comprises a relatively simple in design, light weight and easy to relocate port security barrier which is designed to protect watercraft and ocean going vessels from attack by explosive laden boats which are generally 65 feet or less in length and travel at speeds of 50 knots or greater.

The port security barrier includes multiple barrier float assemblies connected to one another to form the barrier. Each barrier float assembly is approximately 40 feet in length and includes two pontoons which are located near each end of the assembly. The barrier float assembly also has a main longitudinal net support beam which includes a pair of net fence post located near each end of the longitudinal net support beam. The fence post provide support for a horizontal line or wire to which is attached a nylon barrier net, which functions as a capture net. The nylon barrier net operates as the capture mechanism for the port security barrier preventing a high speed boat from entering a restricted port area.

A pair of identical saddle and belly band assemblies secure each of the pontoons to the main longitudinal net support beam. A flanged sleeve connector is used to secure adjacent barrier float assemblies to each other.

One end of the barrier float assembly is designed to accommodate a latching mechanism that is used to couple the barrier float assembly to a mooring buoy. The latching mechanism allows the barrier float assembly to be swung open and then closed acting as a gate for vessel traffic which passes through the assembly into and out of a port facility.

DETAILED DESCRIPTION OF A PREFERRED EMBODIMENT

Figure 1:
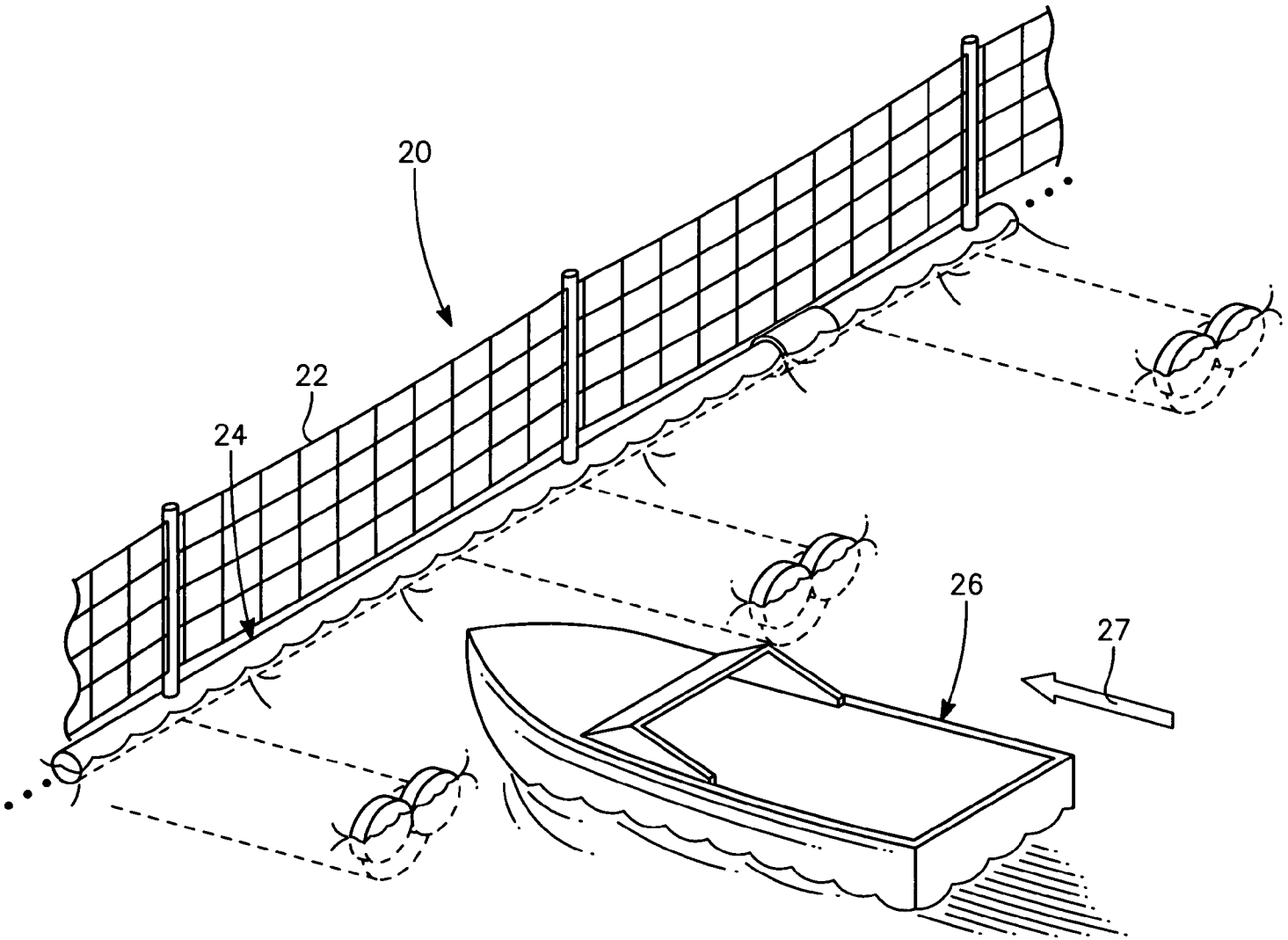
FIG. 1 is a view of the port security barrier which is used to stop explosive laden watercraft from entering a restricted area such as a port.

Referring to FIGS. 1-4, the port security barrier 20 is a moored nylon barrier net 22 and pontoon structure 24 that provides waterfront security to stop, delay or discourage attack by boats 26 of 65 feet less on high value waterfront assets. The nylon net 22, it attachments and connection to its moorings provide the main boat stopping capability for boats traveling in the direction indicated by arrow 27. The supporting pontoon structure 24 holds the nylon net 22 in position and also serves to dissipate a portion of the kinetic energy from the attacking boat 26.

The port security barrier 20 is designed to protect ocean going vessels and watercraft and stop approximately 99.9% of United States commercial boats with a minimum working stopping capacity of approximately 1.8 million foot-pounds of kinetic energy. The barrier 20 also has a factor of safety to increase net replacement time, thus, the net boat stopping capacity is approximately 3.6 million foot-pounds.

The nylon net 22 has five horizontal members 30 of ¾ inch diameter nylon with a spacing of 15 inches and 21 vertical members/nylon ropes 32 of ⅝-inch diameter nylon with a spacing of 24 inches. The nylon net 22 generally has a length of 42 feet which is the approximate length of each barrier float assembly.

Net 22 in another embodiment comprises a mesh in which there is 13¾" spacing between horizontal ropes 30 and 18" spacing between vertical ropes 32. The height of net 22 is five feet. In this embodiment the horizontal ropes 30 are ¾" 12-strand braided nylon, with a minimum breaking strength of 17,900-LBS. The vertical ropes are ⅝" or ¾" 12-plait nylon, with a minimum breaking strength of 13.900-LBS. Each rope 30 and 32 of nylon net 22 is pre-shrunk or stabilized against water shrinkage.

The capture net's horizontal members/ropes 30 and vertical members/ropes 32 that are integrally connected to one another such that tensile loads introduced into the capture net are distributed throughout the horizontal members 30 and the vertical members 32 of the capture net 22.

Barrier float assembly 40 has a netting support structure consisting of a netting termination post 42 located near one end of the main longitudinal net support beam 44, a fence post 46 located on net support beam 44 approximately 66-⅝" from termination post 42, and a fence post 48 located near the other end of net support beam 44.

The excess netting portion 50 located at the left end of net 22 is secured to netting termination post 42 by five anchor shackles 52 attached to termination post 42. Each of the five horizontal ropes 30 has an eye loop 54 at the left end of the rope 30. The eye loop 54 at the left end of each of the five horizontal ropes 30 of net 22 secures the left end of the rope 30 to one of the anchor shackles 52 attached to termination post 42.

There is a lanyard 53 in proximity to each termination post 42. Lanyard 53 has a minimum breaking strength of 90,000 pounds.

At this time it should be noted that the barrier float assemblies which are at the end of a chain of barrier float assemblies, such as barrier float assembly 40 are the only assemblies which include a netting termination post.

Wire ties 56 are used to secure the five horizontal ropes 30 of net 22 to fence post 46. In a like manner, wire ties 58 are used to secure the eye loop 55 at the right end of each horizontal rope 30 to the fence post 48. Five anchor shackles 60 are attached to fence post 48 which are also used to secure the five horizontal ropes 30 of net 22 to fence post 48. The eye loops 54 and 55 are 9-inch inside length at each end of the rope 30 with a 4-3-2 plated rope splice.

Nylon net 122 is the section of the barrier net 124 positioned between adjacent barrier float assemblies 40 and 120 The five anchor shackles 60 secure the left end of nylon net 122 to net post 48. The right end of nylon net 122 is secured to fence post 126 by five wire ties 128.

At this time it should be noted that a portion of the nylon capture net at one of each of the barrier float assemblies overlaps the adjacent barrier float assembly and is attached to one of the fence post of the adjacent barrier float assembly. For example, nylon net 122 is the portion of nylon capture net 124 for barrier float assembly 120 which is attached the right fence post 48 of barrier float assembly 40, At this time it should also be noted that the vertical and horizontal ropes used to assemble the barrier net 22 are coated with a marine grade finish (various colors) at the time of manufacture to minimize nylon shrinkage caused by exposure to water. A polyurethane water base coating (maximum allowable dilution rate =2 parts water to 1 part polyurethane) is applied as a final UV protection to each rope 30 and 32 of nylon net 22.

Positioned a top fence post 46 is an aid to navigation light 62 which is set to various flash patterns. The flashing navigation lights are installed on every other barrier float.

A horizontal galvanized or stainless steel wire rope 66 is supported above the upper horizontal rope 30 of nylon net 22. Steel wire rope 66 is secured at one end to fence post 46 by a turnbuckle and sleeve compression assembly 70. Steel wire rope 66 is secured at the opposite end to fence post 48 by a sleeve compression assembly 72. The turnbuckle of turnbuckle and sleeve compression assembly 70 allows a user to adjust steel wire rope 66 such that rope 66 drops no more than six inches between fence post 66 and 68 with nylon net 22 installed.

Between fence post of the port security barrier 20, the upper horizontal net rope 30 is secured to the wire rope 66 with wire ties 64 spaced approximately 18-inches apart. The tail end of the wire ties 64 also serve as a bird deterrent.

Similarly, a horizontal galvanized or stainless steel wire rope 74 is supported above the upper horizontal rope 30 within the excess netting portion 50 of nylon net 22. Steel wire rope 74 is secured at one end to netting termination post 42 by a turnbuckle and sleeve compression assembly 76. Steel wire rope 74 is secured at the opposite end to fence post 46 by a sleeve compression assembly 78.

A warning sign 80 which warns an intruder that access to the area beyond barrier 20 is restricted is affixed to the nylon net 22. Warning sign 80 is an etched metal sign inscribed in 3-inch high letters and is hung on nylon net 22 from the threat side of the netting clear of the net support structure. One warning sign is hung on every second barrier float.

Located near each end of the main longitudinal net support beam 44 of barrier float assembly 40, are two 14-foot long 24-inch OD pontoons 82 and 84. Pontoons 82 and 84 are either foam filled or have an interior which hollow, i.e. not filled with foam. The pontoons 82 and 84 of barrier float assembly 40 are generally perpendicular to the main net support beam 44 of barrier float assembly and are spaced approximately 26 feet apart center line to center line.

The main longitudinal beam 44 used in the preferred embodiment is a 12×8×¼ inch structural steel beam, which is chemical and corrosion resistant. A pair of identical saddle and belly band assemblies 86 secure each of the foam filled pontoons 82 and 84 to the main longitudinal net support beam 44.

It should be noted that other types of beams could be used as the main longitudinal support beam. For example, a 12.75-inch OD HDPE (high density polyethylene) beam could be used as the main longitudinal beam for port security barrier 20. This type of beam is extremely chemical and corrosion resistant and would provide more than adequate protection from the corrosive effects of seawater.

Similarly barrier float assembly 120 has a main net support beam 140 and a pair of foam filled pontoons 142 and also a nylon net 124 which operates as a capture net to deter high speed watercraft from entering a restricted area such as a military ship docking facility.

The overall length of each of each barrier float assembly 40 and 120 is approximately 40 feet.

Figure 5:
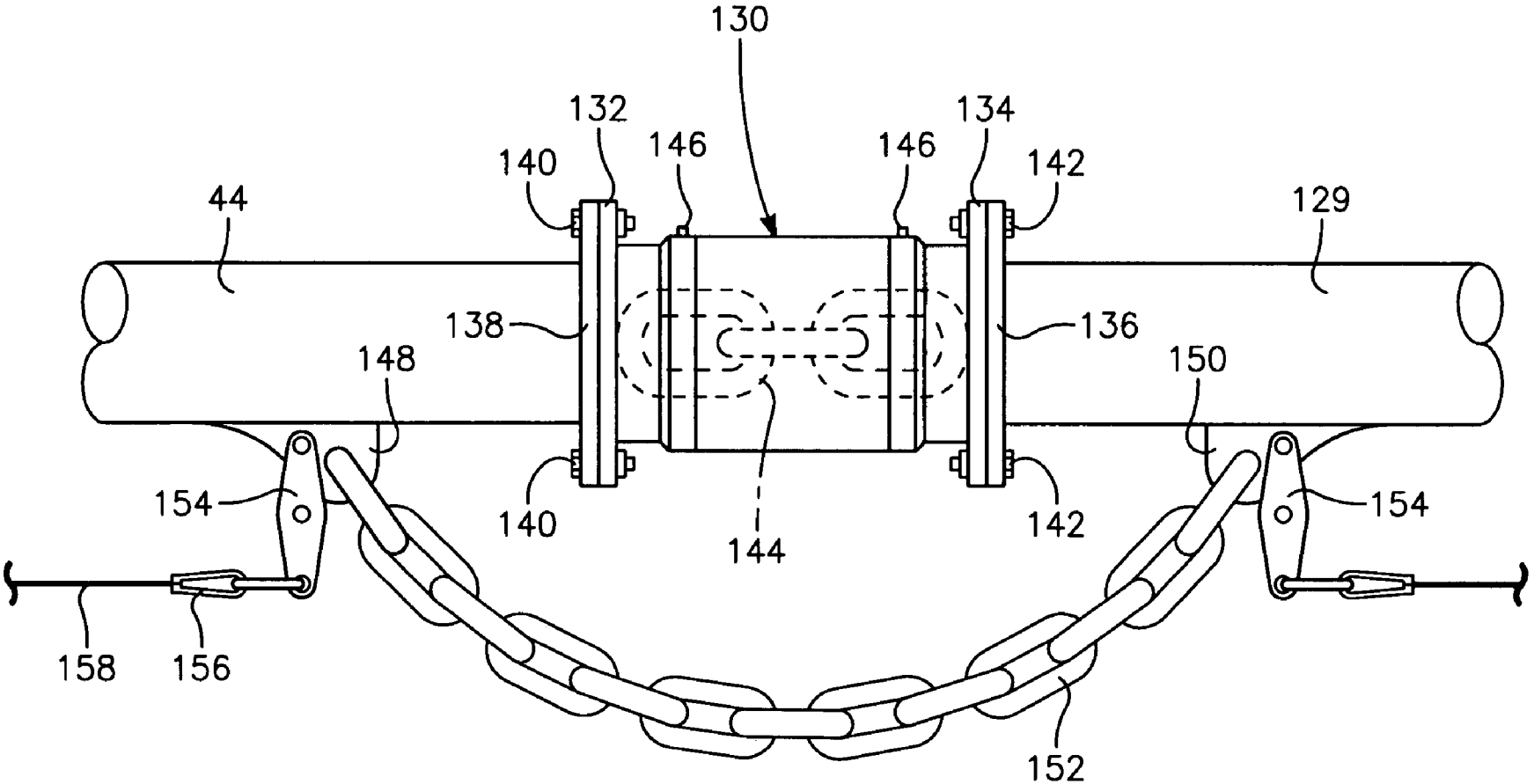
FIG. 5 is a detailed view of the flange sleeve connector and safety chain of FIG. 3.

Referring to FIG. 5, there is shown a flanged sleeve connector 130 which connects the longitudinal net support beam 44 for barrier float assembly 40 to the longitudinal net support beam 129 for barrier float assembly 120. There is located at the ends of connector 130 a pair of flanges 132 and 134. Flange 132 of connector 130 aligns with flange 138 of support beam 44 and eight bolts and nuts 140 are used to affix flange 132 to flange 138. In the same manner, flange 134 of connector 130 aligns with flange 136 of support beam 129 and eight bolts and nuts 142 are used to affix flange 132 to flange 138. Centrally located within each flange sleeve connector 130 is a section of chain 144 which is held in position within connector 130 by a pair of pins 146 inserted into connector 130, such that the structural loads are carried from support beam 44 through flanges 138 and 132, next through chain 144 and then through 134 and 136 to support beam 129. The chain 144 is encased within a urethane compound in connector 130 in order to allow the connector 130 to transfer loads in compression as well as limit wear and bending.

Attached to longitudinal net support beam 44 is a tow bracket 148 which is positioned inward from flange 138 of support beam 44. Attached to longitudinal net support beam 129 is a tow bracket 150 which is positioned inward from flange 136 of support beam 129. The tow brackets 148 and 150 are used to secure a safety chain 152 to each of longitudinal net support beams 44 and 129 when the support beams 44 and 129 are connected as shown in FIG. 5.

The safety chain assemblies 152 are 11 chain links long plus two end links or two detachable links suitable for assembly to shackles 149 at each end of chain 152. The shackles 149 are secured to tow brackets 148 and 152.

Each tow bracket 148 and 150 also has a kayak wire support bracket 154. Attached to kayak wire support bracket 154 is a turnbuckle 156 for one end of a kayak guard wire 158. The other end of kayak guard wire 158 is secured to a kayak wire support bracket 160 attached to support beam 44 adjacent pontoon 82. Kayak guard wires 158, 162 and 164 run the length of support beam 44 to prevent kayak and canoes from passing underneath the port security barrier into restricted waters.

Figure 2:
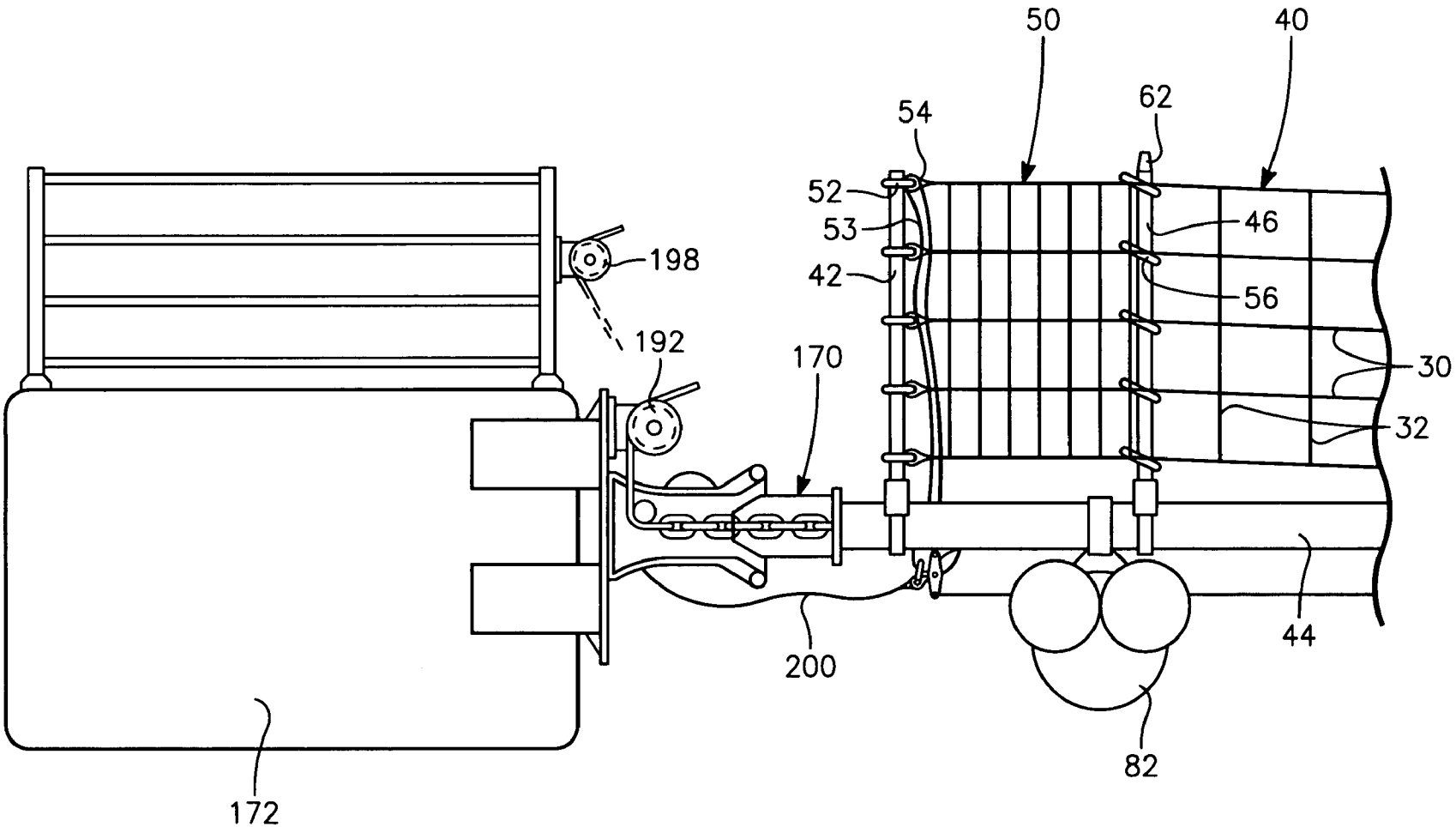
FIG. 2 is an overall view of the port security barrier of FIG. 1 when connected to a buoy.
Figure 3:
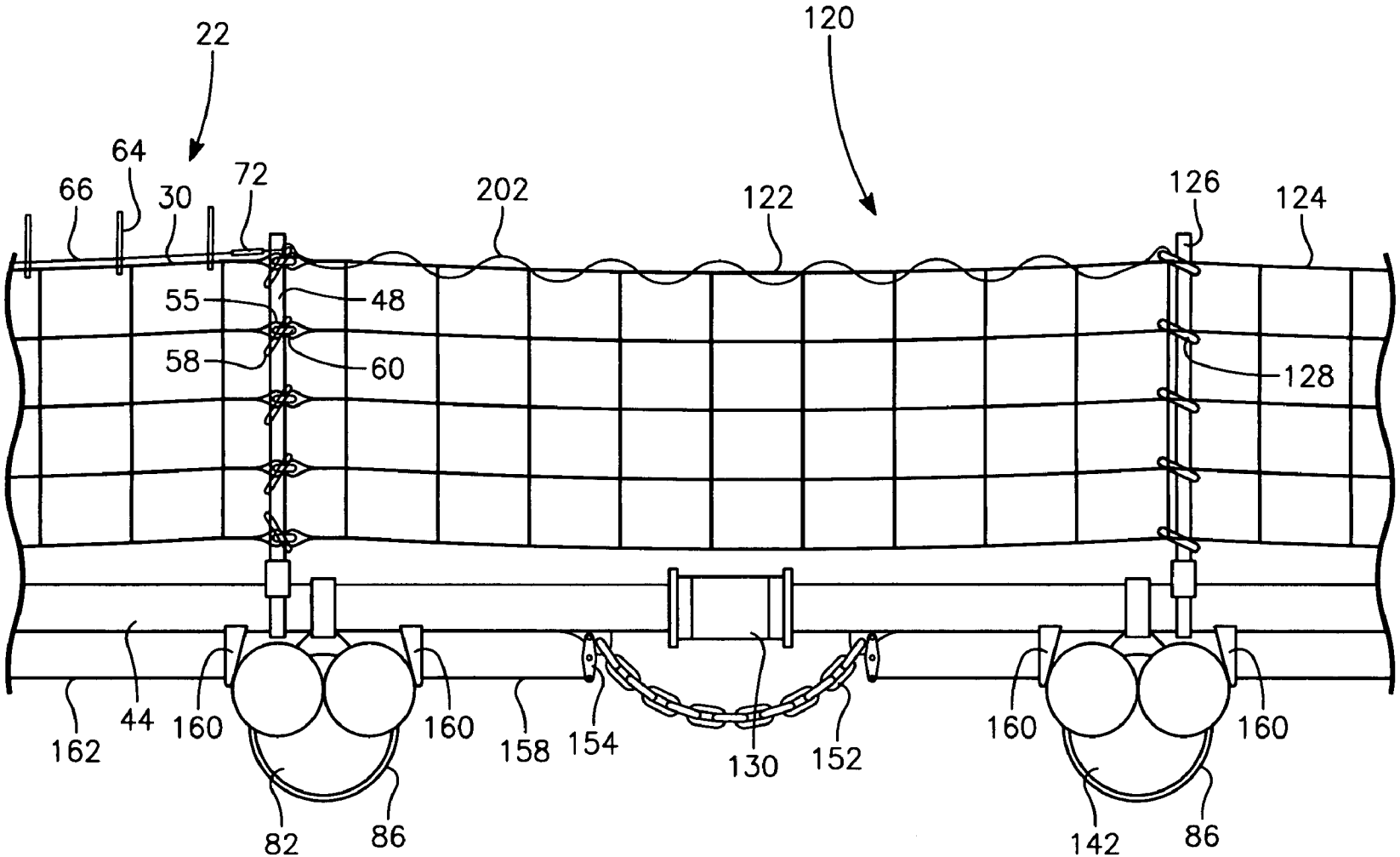
FIG. 3 is a view illustrating the connection of one barrier float assembly to an adjacent barrier float assembly within the port security barrier of FIG. 1.
Figure 4:
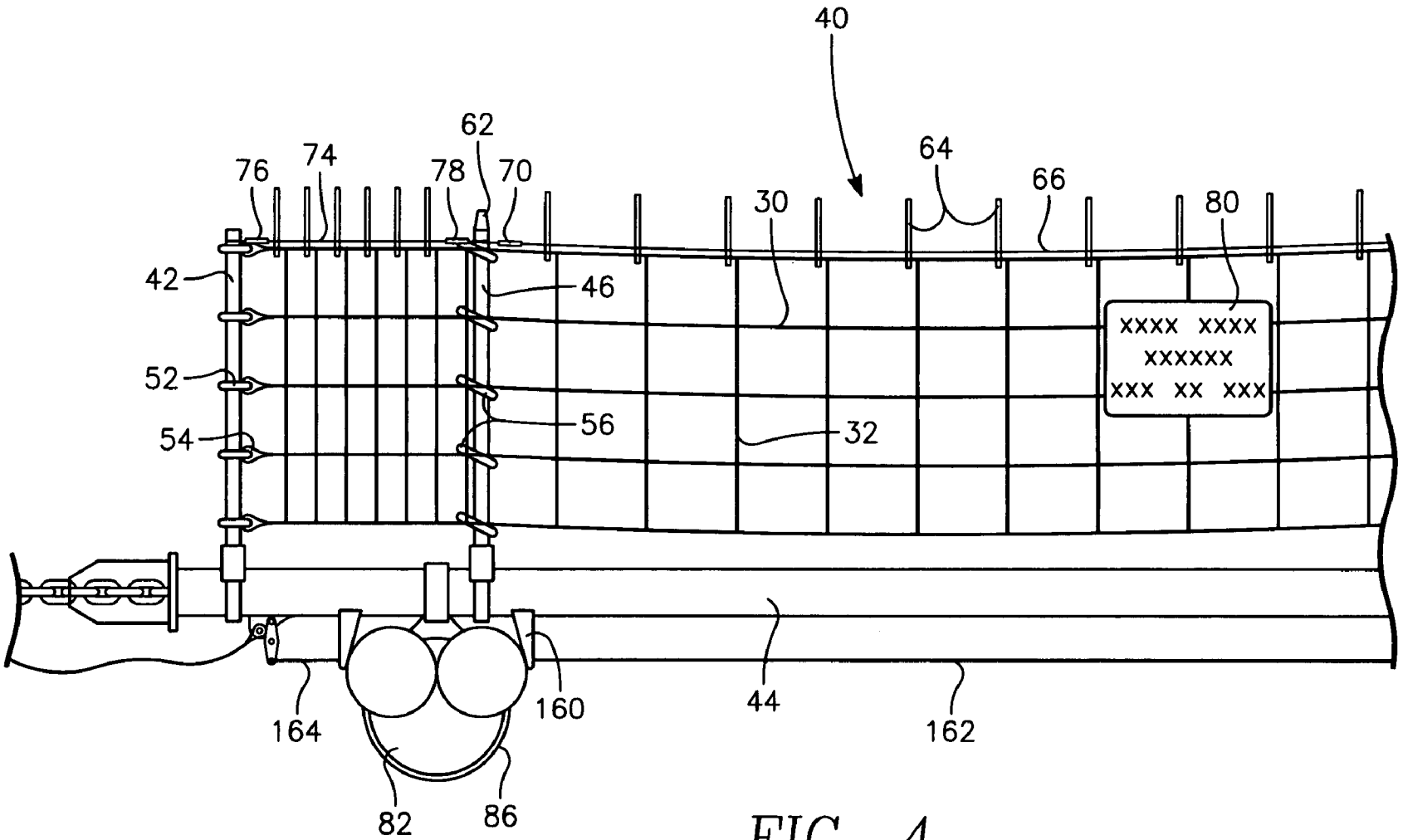
FIG. 4 is a detailed view illustrating one of the barrier float assembly for the port security barrier of FIG. 1.
Figure 6:
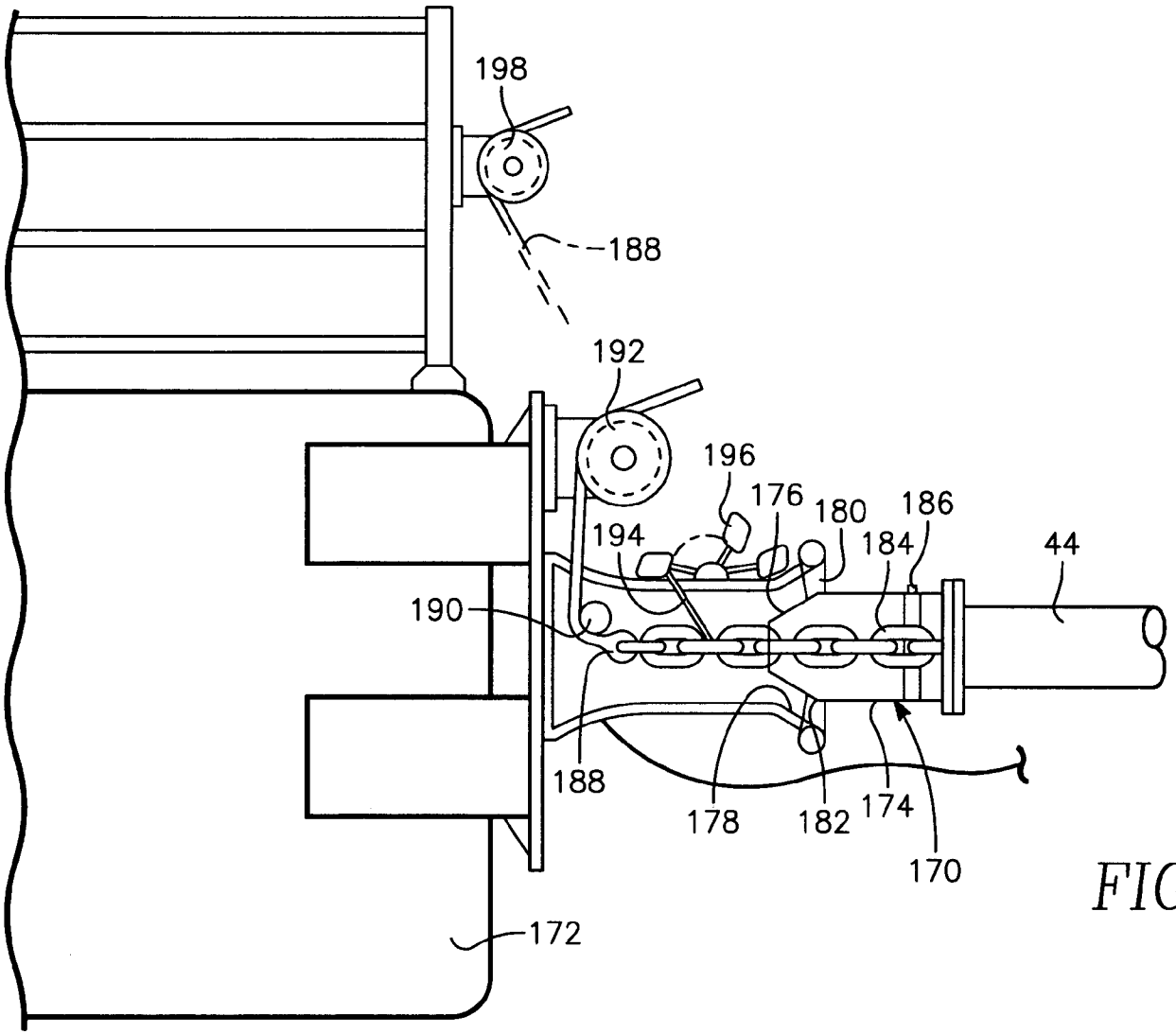
FIG. 6 is a detailed view of a latch connector assembly and the latch connector receiver of FIG. 2.

Referring to FIGS. 2 and 6, there is shown a latch connector assembly 170 which secures the main longitudinal net support beam 44 for barrier float assembly 40 to a buoy 172. Attached to the longitudinal net support beam 44 which is connected to buoy 172 is a latch connector spear element 174. Latch connector spear 174 has at one end an angled surface 176 which is angled inward in the manner shown in FIG. 6. Mounted on buoy 172 is a latch connector receiver 178 which has an alignment member 180. The alignment member 180 has an inner surface 182 which is angled so as to receive and mate with the angled surface 176 of connector spear 174 and secure the support beam 44 to latch connector receiver 178.

A tension element 184 is centrally located in the latch connector spear 174. A pin 186 is used to secure one end of tension element 184. The opposite end of tension element 184 is connected to a lanyard 188. Lanyard 188 engages a pair of sheaves 190 and 192 mounted on buoy 72 has its opposite connected to a tug boat (not illustrated). When it is desired to close the latch connector assembly 170, the tug boat pulls the lanyard 188 around the sheaves 190 and 192 in a clockwise direction, which pulls the tension element 184 and connector spear 174 into the interior of latch connector receiver 178.

The latch connector receiver 178 has a locking element 194 in its interior which engages either tension element 184 or another component of the connector spear 174 in the manner illustrated in FIG. 6, to prevent rearward movement of the tension element 184, thereby securing the connector spear 174 and thus the main longitudinal net support beam 44 to buoy 172. The locking element 194 has a release handle 196 which allows a user disengage the locking element 194 from the tension element 184 and release the latch connector spear 174 from the latch connector receiver 178. This, in turn, results in the barrier float assembly 40 being released from buoy 172.

A hand winch 198 mounted on buoy 172 can also be used to secure barrier float assembly 40 to buoy 172. One end of lanyard 188 is rotatably connected to the hand winch 198 while the other end of lanyard 188 is connected to tension element 184. By rotating the winch 198 in a counter-clockwise direction the user draws the latch connector spear 174 into the latch connector receiver 178 securing the main longitudinal net support beam 44 of barrier float assembly 40 to buoy 172.

Other connectors could be used to secure the main longitudinal net support beam 44 for barrier float assembly 40 to a buoy 172. For example, the connector could be a high strength flexible wire rope or a nylon rope have similar characteristics.

A safety line 200 (FIG. 2) is strung between the main longitudinal net support beam 44 for barrier float assembly 40 and the buoy 172. The safety line 200 is 1-⅛" diameter lanyard which has an overall length of approximately ten feet. Safety line 200 also functions as a tow line.

There is also a ½-inch diameter support rope 202 (FIG. 3) strung between fence post 48 and fence post 126 along the upper edge of nylon net 122. This support rope 202 provides support for the nylon barrier net between adjacent barrier float assemblies 40 and 120.

Figure 7:
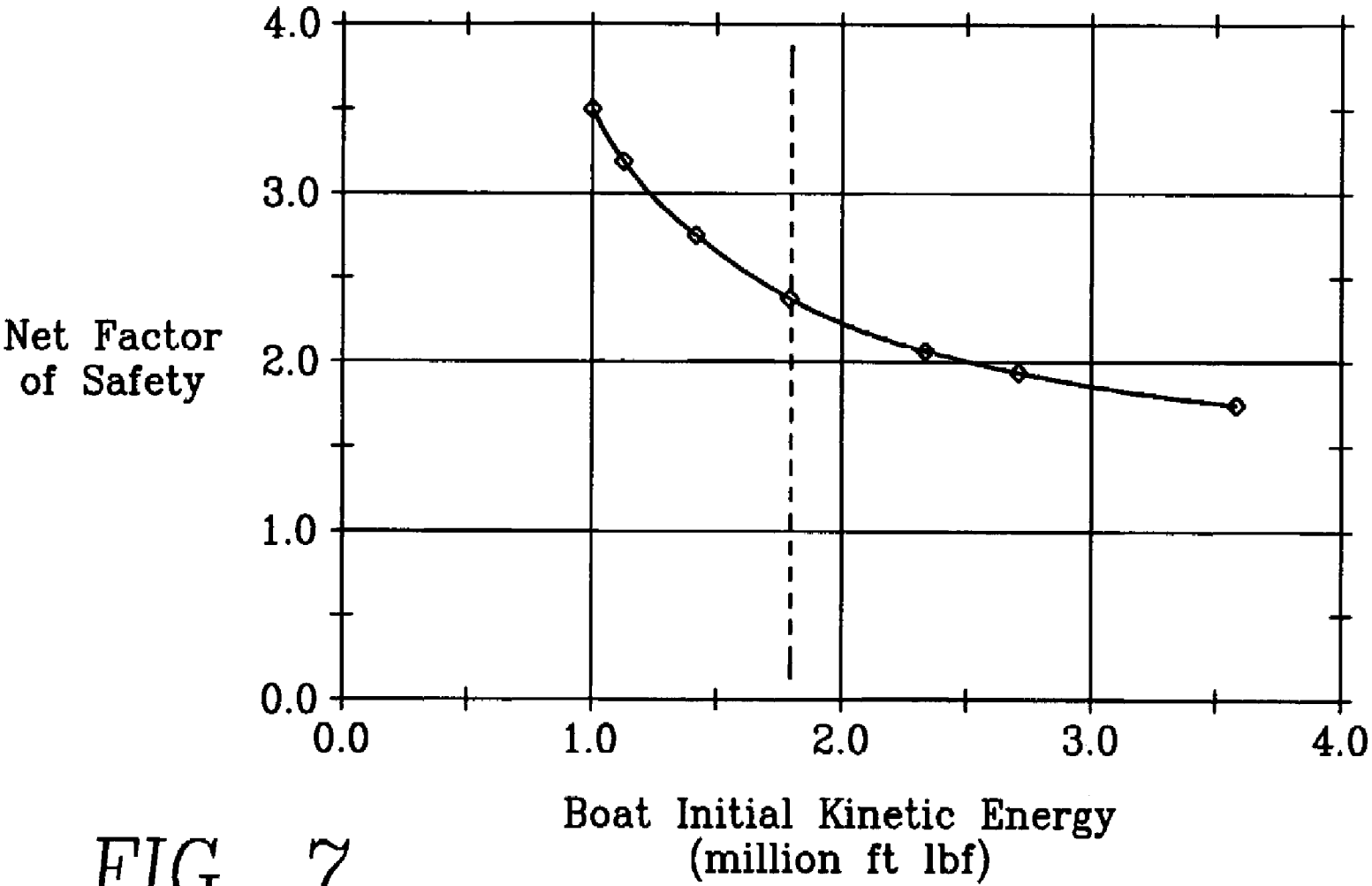
FIG. 7 is a plot which illustrates the design kinetic energy for the port security barrier as a function of the net factor of safety.
Figure 8:
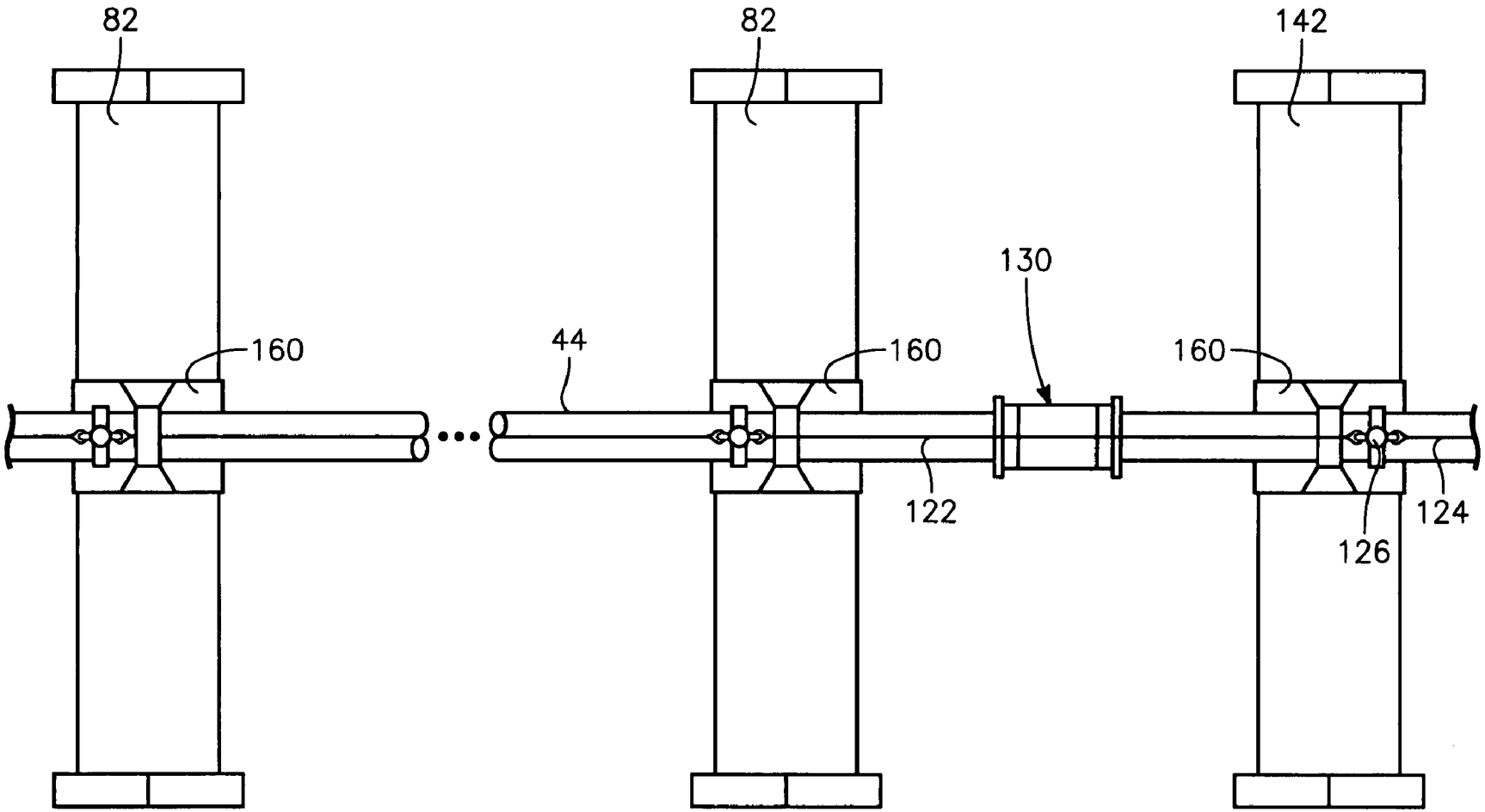
FIG. 8 is a top view of the port security barrier which is used to stop explosive laden watercraft from entering a restricted area such as a port.

Referring to FIGS. 1 and 7, there is shown a plot in FIG. 7 which illustrates the design kinetic energy for the port security barrier 20 as a function of the net factor of safety. The design kinetic energy for port security barrier 20 is 1.8 million foot pounds, which corresponds to a 50-knot initial boat speed for a 16,700 pound boat. The nylon barrier net 22 is loaded very quickly and reaches peak tension at approximately 1.4 seconds after the boat 26 reaches the port security barrier 20. The port security barrier 20 stops the attacking boat 26 in approximately three boat lengths. The plot of FIG. 7 shows that the net 22 provides the required stopping capacity with a factor of safety of 2.3 for the barrier designed kinetic energy of 1.8 million foot pounds. The net factor of safety is 1.8 for a boat with an initial kinetic energy of 3.6 million foot pounds.

From the foregoing, it is readily apparent that the present invention comprises a new, unique, and exceedingly useful low cost port security barrier for preventing attack watercraft from entering a restricted port area, which constitutes a considerable improvement over the known prior art. Many modifications and variations of the present invention are possible in light of the above teachings. It is to be understood that within the scope of the appended claims the invention may be practiced otherwise than as specifically described.

What is claimed is:

1. A port security barrier for protecting a port facility from a waterborne craft laden with explosives, said port security barrier comprising:

(a) a plurality of barrier float assemblies connected to one another to form a chain of connected barrier float assemblies to protect said port facility;

(b) each of said barrier float assemblies including:

(i) a longitudinal net support beam;

(ii) a generally rectangular shaped synthetic fiber capture net extending vertically upward from said longitudinal net support beam, said synthetic fiber capture net having a standard length which is approximately the length of said longitudinal net support beam, and a height which is sufficient to prevent said waterborne craft from penetrating said port facility wherein said synthetic fiber capture net has a plurality of equally spaced apart horizontal members and a plurality of equally spaced vertical members;

(iii) a netting support structure extending vertically upward from said longitudinal net support beam, said netting support structure including a pair of fence post affixed to said longitudinal net support beam wherein said pair of fence post are positioned inward a preselected distance from each end of said longitudinal net support beam and have said synthetic fiber capture net attached thereto; and (iv) a pair of pontoons attached to said longitudinal net support beam and orientated perpendicular to said longitudinal net support beam, said pair of pontoons for each of said barrier float assemblies keeping said port security barrier afloat in a marine environment; and (c) a plurality of flange sleeve connectors, wherein one of said plurality of flange sleeve connectors is attached to each end of the longitudinal net support beams for adjacent barrier float assemblies to connect said adjacent float barriers assemblies to each other;

(d) a netting termination post extending vertically upward from the longitudinal net support beam for said barrier float assemblies positioned at each end of said chain of connected barrier float assemblies, said netting termination post being secured to an end portion of the synthetic fiber capture net of said barrier float assemblies positioned at each end of said chain of connected barrier float assemblies; and (e) a latching connector assembly located at one end of the longitudinal net support beam of said barrier float assembly positioned at each end of said chain of connected barrier float assemblies, wherein said latching connecter assembly is adapted for coupling to and uncoupling from a latching connector receiver mounted on a mooring buoy allowing for said barrier float assembly positioned at one end of said chain of connected barrier float assemblies to be connected to said mooring buoy and disconnected from said mooring buoy, wherein said latching connector assembly for each of said barrier float assemblies located at each end of said chain of connected barrier float assemblies comprises:

(i) a latching connector spear having one end attached to the longitudinal net support beam for each of said barrier float assemblies located at each end of said chain of connected barrier float assemblies, said latching connector spear having an angled surface which is angled inward at the other end;

(ii) a tension element centrally located within the interior of said latching connector spear and a pin to secure one end of said tension element in a fixed position within said latching connector spear, wherein said tension element extends outward from said latching connector spear; and (iii) a lanyard having one end connected to said tension element and an opposite end connected to a towing device, said lanyard passing through the interior of said latching connector receiver to said towing device, said towing device when connected to said device pulling said tension element and said latching connector spear into the interior of said latching connector receiver, wherein said latching connector receiver has an alignment member which has an inner surface angled to receive the angled surface of said latching connector spear and a locking element which engages said tension element preventing rearward movement of said tension element from said latching connector assembly.

2. The port security barrier of claim 1 wherein said synthetic fiber capture net has a boat stopping capability of at least 1.8 million foot-pounds of kinetic energy and a safety factor of 2.0.

3. The port security barrier of claim 1 wherein a portion of the synthetic fiber capture net at one of each of said barrier float assemblies overlaps an adjacent barrier float assembly and is attached to one of the fence post of said adjacent barrier float assembly.

4. The port security barrier of claim 1 wherein said synthetic fiber capture net comprises a mesh having a spacing ranging from eight to twenty four inches between the horizontal members of said synthetic fiber capture net and eight to twenty four inches between the vertical members of said synthetic fiber capture net.

5. The port security barrier of claim 1 wherein each of the horizontal members of said synthetic fiber capture net comprises a horizontal synthetic fiber rope of ¾-inch diameter with a minimum breaking strength of 17,900-LBS, and each of the vertical members of said synthetic fiber capture net comprises a vertical synthetic fiber rope of ⅝-inch diameter with a minimum breaking strength of 13,900-LBS, wherein said horizontal synthetic fiber rope and said vertical synthetic fiber rope each comprise a nylon fiber rope.

6. The port security barrier of claim 1 further comprising a plurality of safety chains wherein one of said plurality of safety chains is attached to each end of the longitudinal net support beams for said adjacent barrier float assemblies to connect said adjacent float barriers assemblies to each other.

7. The port security barrier of claim 1 wherein each of said barrier float assemblies includes a kayak guard wire positioned on an underside of the longitudinal net support beam for each of said barrier float assemblies.

8. The port security barrier of claim 1 wherein said longitudinal net support beam for each of said barrier float assemblies comprises a 12 by 8-inch structural steel tube.

9. The port security barrier of claim 1 further comprising a flashing navigation light mounted on top of one fence post of said pair of fence post of every other of said barrier float assembly, wherein said flashing navigation light is an aid to navigation and is set to flash at various time intervals and flash patterns.

10. The port security barrier of claim 1 further comprising a plurality of wire ties spaced approximately 18-inches apart, wherein said wire ties secure an upper horizontal net rope of said synthetic fiber capture net to a wire rope attached to the fence post of said longitudinal net support beam, said wire ties operating as a bird deterrent.

11. A port security barrier for protecting a port facility from a waterborne craft laden with explosives, said port security barrier comprising:

(a) a plurality of barrier float assemblies connected to one another to form a chain of connected barrier float assemblies to protect said port facility;

(b) each of said barrier float assemblies including:

(i) a longitudinal net support beam, said longitudinal net support beam for each of said barrier float assemblies comprising a beam which is chemical and corrosion resistant;

(ii) a generally rectangular shaped nylon capture net extending vertically upward from said longitudinal net support beam, said nylon capture net having a standard length which is approximately the length of said longitudinal net support beam, and a height which is sufficient to prevent said waterborne craft from penetrating said port facility wherein said nylon capture net has at least five equally spaced apart horizontal members and a plurality of equally spaced vertical members, wherein said nylon capture net has a boat stopping capability of at least 1.8 million foot-pounds of kinetic energy and a safety factor of 2.0;

(iii) a netting support structure extending vertically upward from said longitudinal net support beam, said netting support structure including a pair of fence post affixed to said longitudinal net support beam wherein said pair of fence post are positioned inward a preselected distance from each end of said longitudinal net support beam and have said nylon capture net attached thereto, wherein a portion of the nylon capture net at one of each of said barrier float assemblies overlaps an adjacent barrier float assembly and is attached to one of the fence post of said adjacent barrier float assembly; and (iv) a pair of pontoons attached to said longitudinal net support beam and orientated perpendicular to said longitudinal net support beam, said pair of pontoons for each of said barrier float assemblies keeping said port security barrier afloat in a seawater environment; and (c) a plurality of flange sleeve connectors, wherein one of said plurality of flange sleeve connectors is attached to each end of the longitudinal net support beams for adjacent barrier float assemblies to connect said adjacent float barriers assemblies to each other;

(d) a netting termination post extending vertically upward from the longitudinal net support beam for said barrier float assemblies positioned at each end of said chain of connected barrier float assemblies, said netting termination post being secured to an end portion of the nylon capture net of said barrier float assemblies positioned at each end of said chain of connected barrier float assemblies; and (e) a latching connector assembly located at one end of the longitudinal net support beam of said barrier float assembly positioned at each end of said chain of connected barrier float assemblies, wherein said latching connecter assembly is adapted for coupling to and uncoupling from a latching connector receiver mounted on a mooring buoy allowing for said barrier float assembly positioned at one end of said chain of connected barrier float assemblies to be connected to said mooring buoy and disconnected from said mooring buoy, wherein said latching connector assembly for each of said barrier float assemblies located at each end of said chain of connected barrier float assemblies comprises:

(i) a latching connector spear having one end attached to the longitudinal net support beam for each of said barrier float assemblies located at each end of said chain of connected barrier float assemblies, said latching connector spear having an angled surface which is angled inward at the other end;

(ii) a tension element centrally located within the interior of said latching connector spear and a pin to secure one end of said tension element in a fixed position within said latching connector spear, wherein said tension element extends outward from said latching connector spear; and (iii) a lanyard having one end connected to said tension element and an opposite end connected to a towing device, said lanyard passing through the interior of said latching connector receiver to said towing device, said towing device when connected to said device pulling said tension element and said latching connector spear into the interior of said latching connector receiver, wherein said latching connector receiver has an alignment member which has an inner surface angled to receive the angled surface of said latching connector spear and a locking element which engages said tension element preventing rearward movement of said tension element from said latching connector assembly; and (f) a flashing navigation light mounted on top of one fence post of said pair of fence post of every other of said barrier float assemblies, wherein said flashing navigation light is an aid to navigation and is set to flash at various time intervals and flash patterns; and (g) a plurality of safety chains wherein one of said plurality of safety chains is attached to each end of the longitudinal net support beams for said adjacent barrier float assemblies to connect said adjacent float barriers assemblies to each other.

12. The port security barrier of claim 11 wherein said nylon capture net comprises a mesh having a spacing of 13-¾ inches between the horizontal members of said nylon capture net and 18 inches between the vertical members of said nylon capture net, each of the horizontal members of said nylon capture net comprising a horizontal rope of ¾-inch diameter, 12-strand braided nylon which is orange in color with a minimum breaking strength of 17,900-LBS, and each of the vertical members of said nylon capture net comprising a vertical rope of ⅝" or ¾" 12-plait nylon, orange in color, with a minimum breaking strength of 13,900-LBS.

13. The port security barrier of claim 11 wherein each of said barrier float assemblies includes a kayak guard wire positioned on an underside of the longitudinal net support beam for each of said barrier float assemblies.

14. The port security barrier of claim 11 further comprising a plurality of wire ties spaced approximately 18-inches apart, wherein said wire ties secure an upper horizontal net rope of said synthetic fiber capture net to a wire rope attached to the fence post of said longitudinal net support beam, said wire ties operating as a bird deterrent.

* * * * *